US007059218B1

(12) United States Patent
Lin et al.

(10) Patent No.: US 7,059,218 B1
(45) Date of Patent: Jun. 13, 2006

(54) DRIVING MEMBER SECURING DEVICE FOR HAND TOOLS

(75) Inventors: Yu-Cheng Lin, Taichung (TW); Hui-Chen Chang, Taichung (TW)

(73) Assignee: Lea Way Hand Tool Corporation, Taichung (TW)

( * ) Notice: Subject to any disclaimer, the term of this patent is extended or adjusted under 35 U.S.C. 154(b) by 0 days.

(21) Appl. No.: 11/293,096

(22) Filed: Dec. 5, 2005

(51) Int. Cl.
*B25B 13/46* (2006.01)

(52) U.S. Cl. ..... 81/60; 81/61; 81/62

(58) Field of Classification Search ..... 81/60, 81/61, 62

See application file for complete search history.

(56) References Cited

U.S. PATENT DOCUMENTS 6,488,136 B1 * 12/2002 Chang ..... 192/46

* cited by examiner

*Primary Examiner*—Lee D. Wilson
*Assistant Examiner*—Shantese McDonald
(74) *Attorney, Agent, or Firm*—Rosenberg, Klein & Lee

(57) ABSTRACT

A driving member securing device for a hand tool includes a control member which has a skirt portion and a flange extends from an inner periphery of a central hole of the control member. The flange has a plurality of projections. The hand tool has a toothed wheel rotatably received in the head of the hand tool and an engaging hole is defined through the toothed wheel. The driving member has an insertion which is inserted into the engaging hole of the toothed wheel and includes a plurality of ridges and grooves. A groove is defined in the ridges and the grooves so that the flange of the control member is movably engaged with the groove to secure the driving member.

4 Claims, 9 Drawing Sheets

PRIOR ART

PRIOR ART

DRIVING MEMBER SECURING DEVICE FOR HAND TOOLS

FIELD OF THE INVENTION

The present invention relates to a securing device for quickly secure or release a driving member attached to a hand tool.

BACKGROUND OF THE INVENTION

A conventional ratchet tool 10 is shown in FIG. 8 and generally includes a handle 14 and a head 11 which is connected to the handle 14 and a through hole 12 is defined through the head 11 so as to receive a toothed wheel 20 in the through hole 12. A pawl is received in a recess defined in an inner periphery of the through hole 12 so as to engage with the toothed wheel 20. The toothed wheel 20 has an engaging hole 26 which is defined by an inner periphery which includes alternatively arranged ridges 24 and grooves 262. Each groove 262 includes two sides 260 and a each ridge 24 includes a surface 261 which is located between two sides 260 and connected by two respective rounded surfaces 263. A driving member 30 includes an upper section 301 and a lower section 302, a plurality of positioning grooves 32 are defined in the upper section so that when the driving member 30 is inserted into the engaging hole 26 of the toothed wheel 20, the ridges 24 are engaged with the positioning grooves 32. The lower section 302 has a polygonal surface 34 for being engaged with a socket for example. The driving member 30 does not well secured to the engaging hole 26 of the toothed member 20 may easily drop from the hand tool 10.

Another hand tool is disclosed in FIG. 9 which includes a head with a through hole 12 and a groove 120 is defined in an inner periphery of the through hole 12. A toothed wheel 20 is rotatably received in the through hole 12 and includes a plurality of teeth 28 defined in an outer periphery thereof and a polygonal engaging hole 27 is defined through the toothed wheel 20. A clip is engaged with the groove 120 to prevent the toothed wheel 20 from dropping from the through hole 12. A flexible member 70 is engaged with a securing groove 29 defined in the polygonal engaging hole 27 and includes two protrusions 71 which bias and position a driving member (not shown) which is inserted into the engaged hole 27 of the toothed wheel 20. However, the driving member will be frequently removed from the toothed wheel 20 so that the flexible member 70 tends to be fatigue in a short period of time. Once the flexible member 70 cannot securely hold the driving member, the driving member could drop from the toothed wheel 20 during use.

The present invention intends to provide a securing device for securing a driving member to a hand tool and the device includes a control member which is rotatable to secure and release the driving member.

SUMMARY OF THE INVENTION

The present invention relates to a combination of hand tool and driving member, wherein the hand tool has a through hole defined through the head thereof and a positioning groove is defined in an inner periphery of the through hole. A toothed wheel is rotatably received in the through hole and a toothed surface and a plain surface are respectively defined in an outer periphery of the toothed wheel. The plain surface is located close to a first end of the toothed wheel and has a recess defined radially therein so that a positioning unit is movably received in the recess. A first groove is defined in the outer periphery of the plain portion. A control member has a central hole and a skirt portion extends from a periphery of the control member. A flange extends inward from an inner periphery of the central hole and has a plurality of projections. A driving member has an insertion which is inserted into the engaging hole of the toothed wheel. The insertion includes a plurality of ridges and grooves. A third groove is defined in an outer periphery of the insertion and in the ridges and the grooves. The flange of the control member is movably engaged with the third groove.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
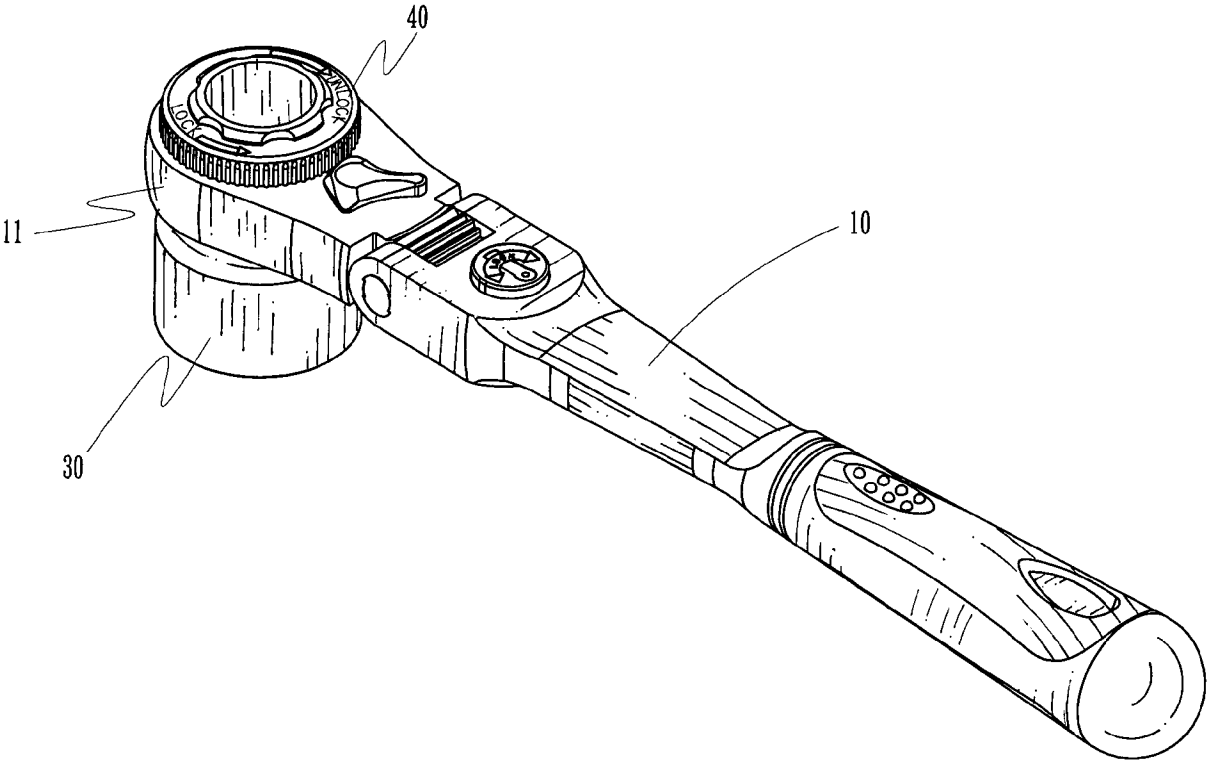
FIG. 1 is a perspective view to show a combination of hand tool and driving member of the present invention.
Figure 2:
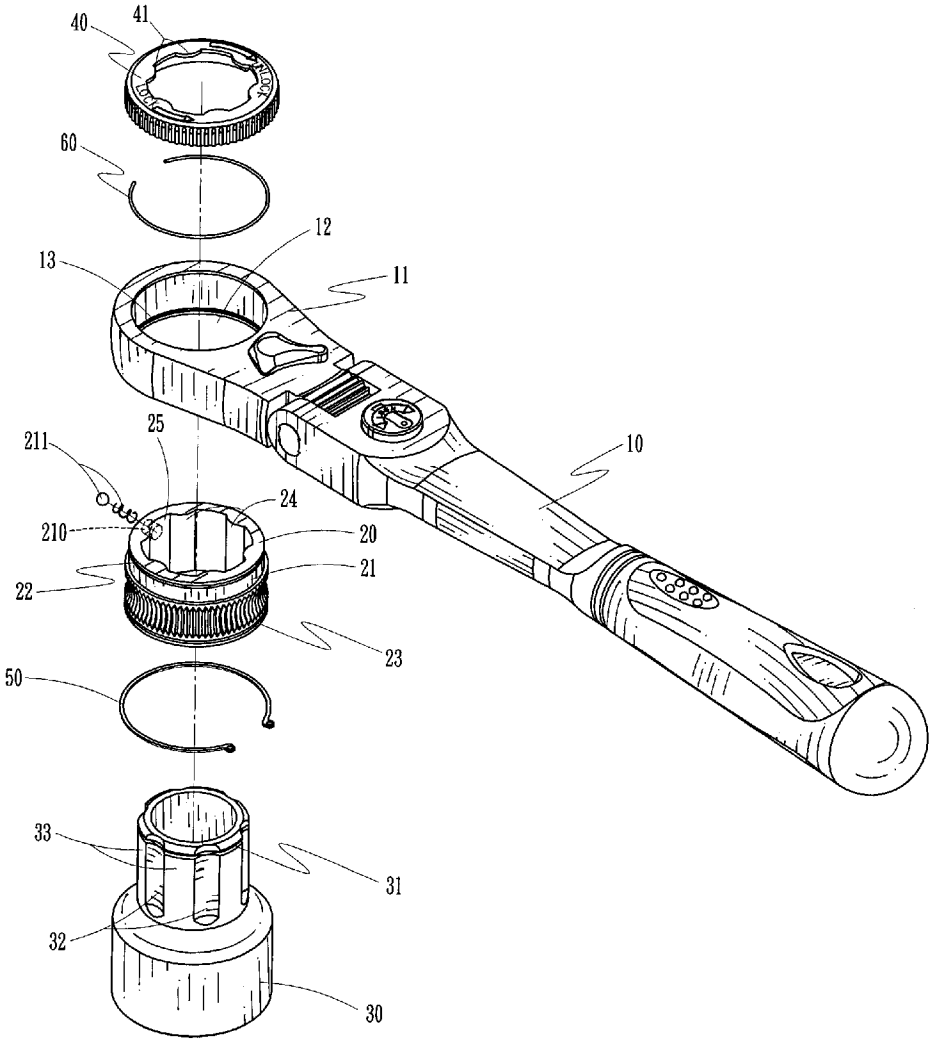
FIG. 2 is an exploded view to show the combination of the present invention.
Figure 3:
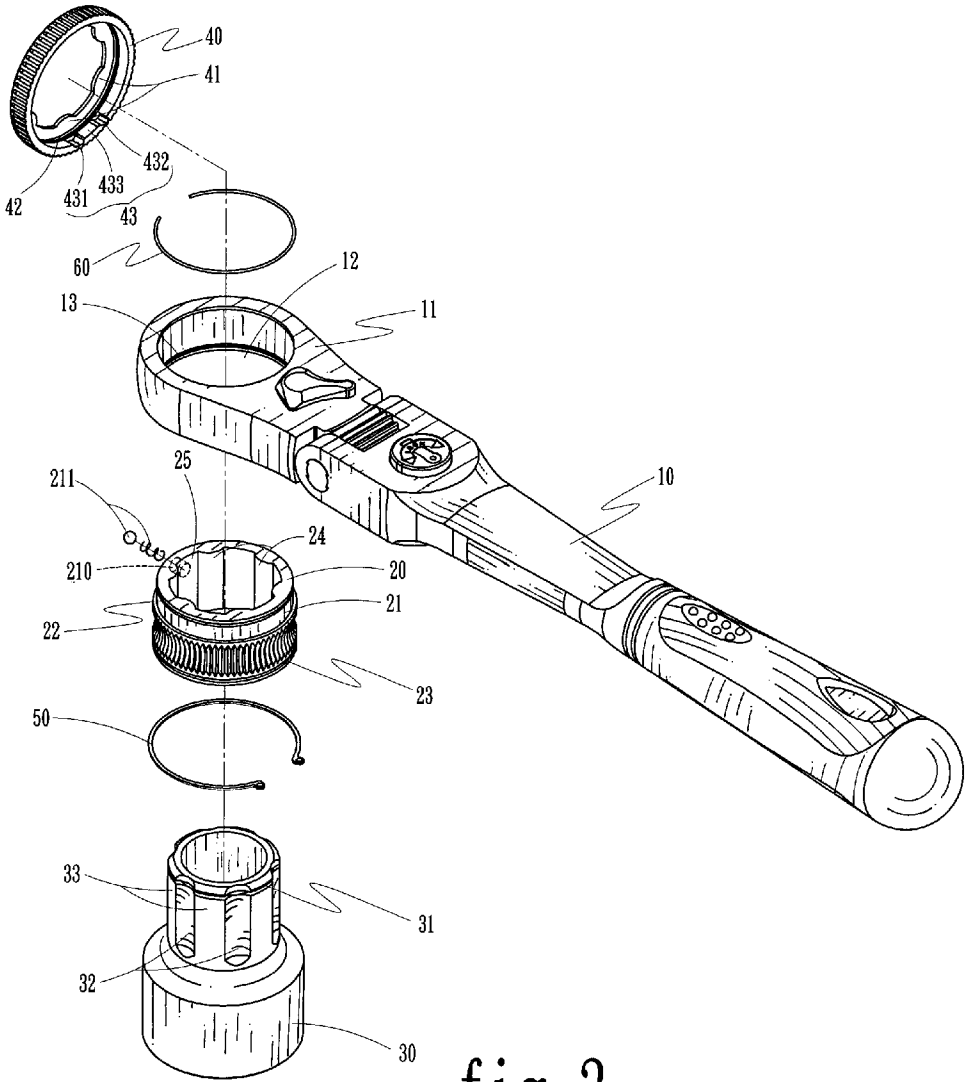
FIG. 3 is an exploded view to show the combination of the present invention wherein the underside of the control member is shown.
Figure 4:
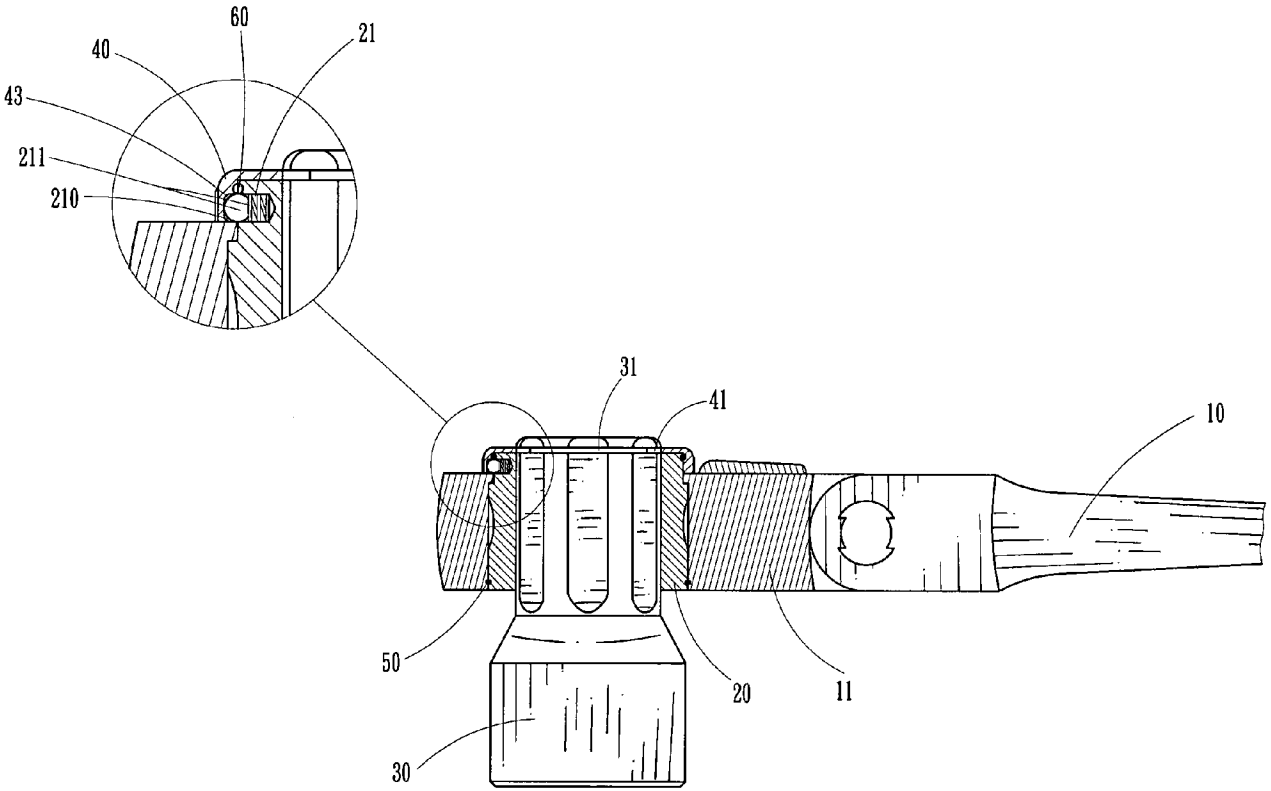
FIG. 4 is a cross sectional view of the combination of the present invention.

Referring to FIGS. 1 to 4, the hand tool 10 of the present invention comprises a handle and a head 11 which is pivotably connected to the handle, and a through hole 12 is defined through the head 11. A ratchet mechanism (not shown) is received in the head 11 and a positioning groove 13 is defined in an inner periphery of the through hole 12.

A toothed wheel 20 is rotatably received in the through hole 12 and has an engaging hole which has a plurality of first ridges 24 and second grooves 25 defined in an inner periphery thereof. A toothed surface and a plain surface 21 are defined in an outer periphery of the toothed wheel 20. The plain surface 21 is located close to a first end of the toothed wheel 20 and has a recess 210 defined radially therein. A positioning unit 211 is movably received in the recess 210 and includes a bead and a spring which pushes the bead outward. A first groove 22 is defined in the outer periphery of the plain portion 21 and a second groove 23 is defined in the outer periphery of the toothed wheel 20 and located close to a second end of the toothed wheel 20. A clip 50 is engaged with the positioning groove 13 and the second groove 23 so that the toothed wheel 20 is retained in the through hole 12 of the head 11.

A control member 40 has a central hole and a skirt portion extends from a periphery of the control member 40. A flange 41 extends inward from an inner periphery of the central hole and has a plurality of projections. The control member 40 is connected to a top of the head 11 and a clip 60 is engaged with the first groove 22 and a connection groove 42 defined in an inner periphery of the skirt of the control member 40. The skirt of the control member 40 has a positioning portion 43 defined in the inner periphery thereof and the positioning portion 43 includes a first notch 431 and a second notch 432. A pushing protrusion 433 is located between the first and second notches 431, 432. The positioning unit 211 is engaged with one of the first and second notches 431, 432.

Figure 5:
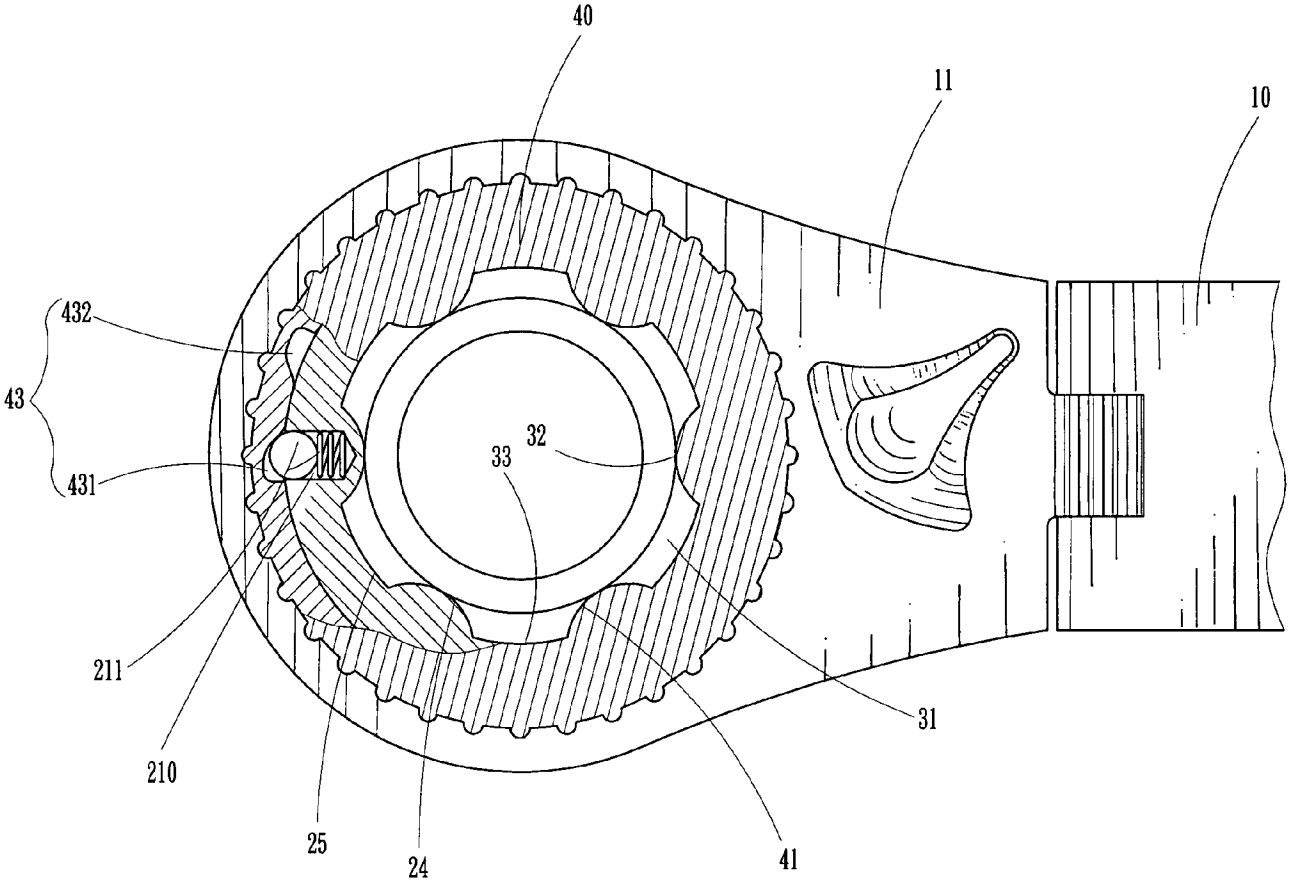
FIG. 5 is a top cross sectional view to show that the projections of the control member is in alignment with the grooves of the insertion of the driving member.

A driving member 30 has an insertion which has a polygonal outer periphery which has a plurality of second ridges 33 and second grooves 32. The insertion is inserted into the engaging hole of the toothed wheel 20, and the first ridges 24 are engaged with the second grooves 32, and the second ridges 33 are engaged with the first grooves 25. A third groove 31 is defined in an outer periphery of the insertion and in the ridges 33 and the grooves 32. The flange 41 of the control member 40 is movably engaged with the third groove 31 as shown in FIG. 5.

Figure 6:
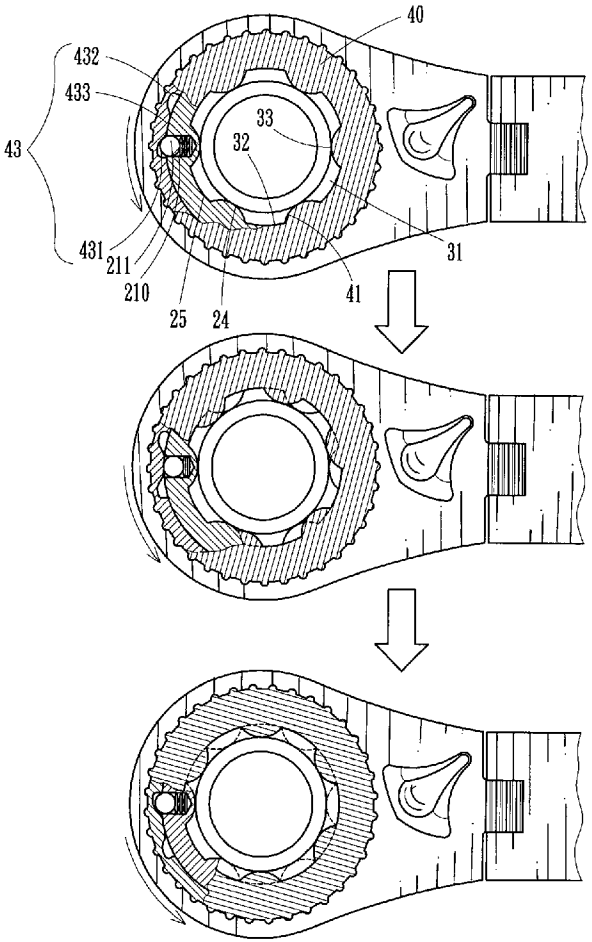
FIG. 6 shows three positions of the projections of the control member when the control member is rotated counter clockwise.
Figure 7:
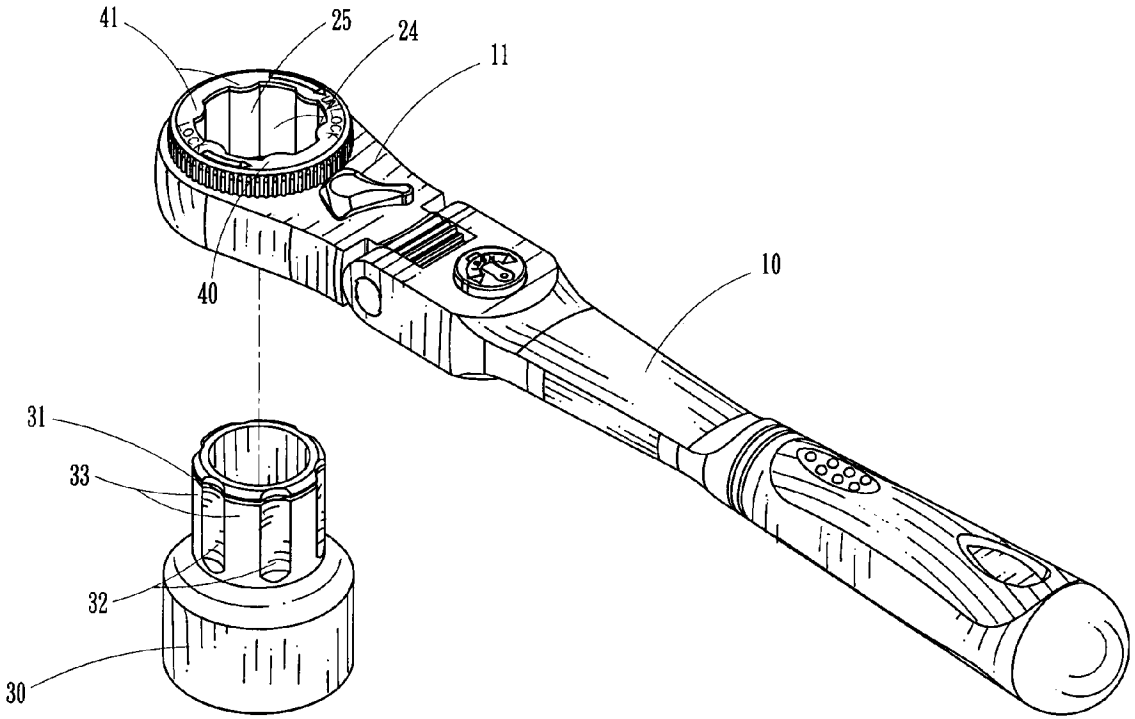
FIG. 7 shows that the driving member is disengaged from the hand tool.
Figure 8:
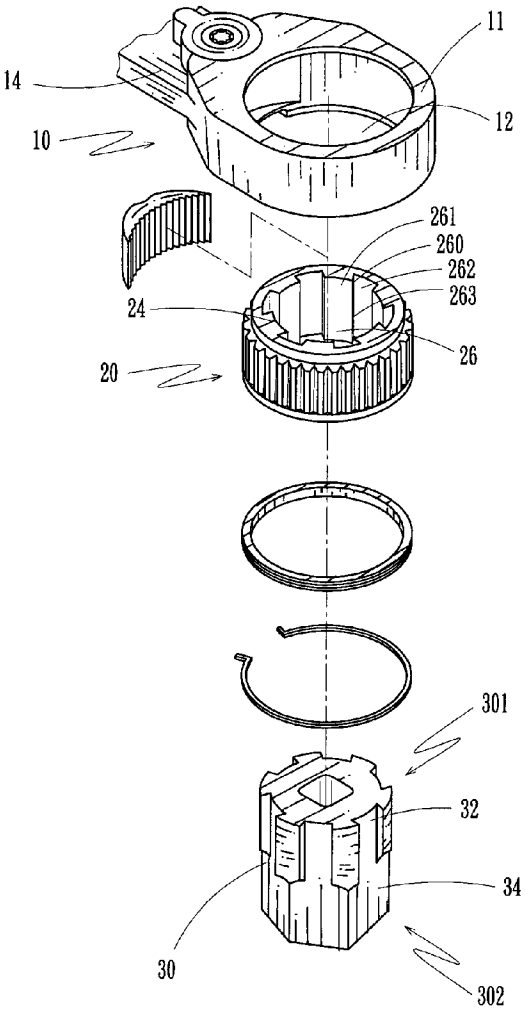
FIG. 8 is an exploded view to show a first conventional hand tool.
Figure 9:
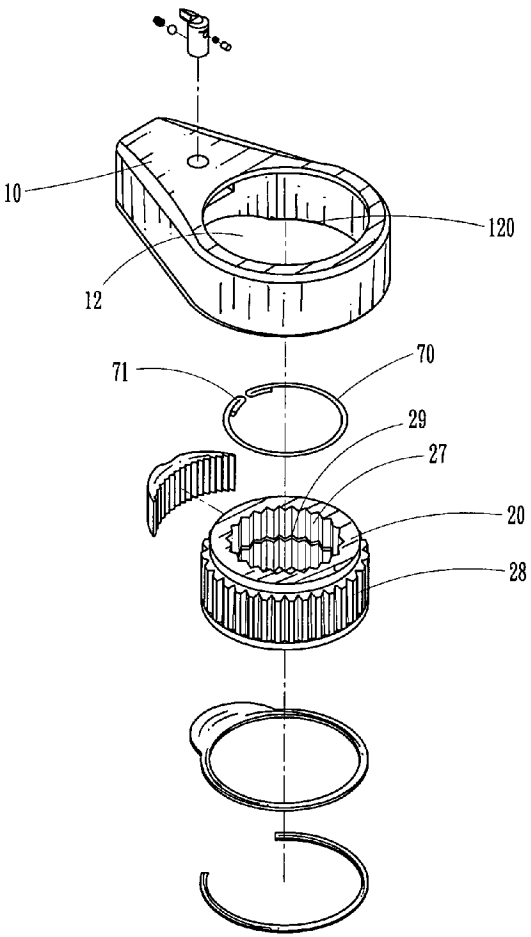
FIG. 9 is an exploded view to show a second conventional hand tool.

As shown in FIG. 6, when rotating the control member 40 counter clockwise, the bead of the positioning unit 211 is removed from the first notch 431 and then pushed by the pushing protrusion 433 inward. The control member 40 is continuously rotated till the bead is engaged with the second notch 432. In the meanwhile, the projections of the flange 41 of the control member 40 are removed from the third groove 31 in the second grooves 32, and are moved to the third groove 31 in the second ridges 33 so that the driving member 30 does not drop from the engaging hole of the toothed wheel 20. When the driving member 30 is to be removed from the head 11, the control member 40 is rotated clockwise to remove the projections from the third groove 31 in the second ridges 33 and to enter the third groove 31 in the second grooves 32. The driving member 30 is easily removed from the hand tool 10 as shown in FIG. 7.

While we have shown and described the embodiment in accordance with the present invention, it should be clear to those skilled in the art that further embodiments may be made without departing from the scope of the present invention.

What is claimed is:

1. A combination of hand tool and driving member, comprising:

a handle and a head connected to the handle, a through hole defined through the head and a positioning groove defined in an inner periphery of the through hole;

a toothed wheel rotatably received in the through hole and having an engaging hole, a toothed surface and a plain surface defined in an outer periphery of the toothed wheel, the plain surface located close to a first end of the toothed wheel and having a recess defined radially therein, a positioning unit movably received in the recess, a first groove defined in the outer periphery of the plain portion;

a control member having a central hole and a skirt portion extending from a periphery of the control member, a flange extending inward from an inner periphery of the central hole and having a plurality of projections, and a driving member having an insertion which is inserted into the engaging hole of the toothed wheel, the insertion having a polygonal outer periphery, a third groove defined in the polygonal outer periphery of the insertion, the flange of the control member being movably engaged with the third groove.

2. The combination as claimed in claim 1, wherein the skirt of the control member has a positioning portion in an inside thereof and the positioning portion includes a first notch and a second notch, a pushing protrusion is located between the first and second notches, the positioning unit is engaged with one of the first and second notches.

3. The combination as claimed in claim 1, wherein a second groove is defined in the outer periphery of the toothed wheel and located close to a second end of the toothed wheel, a clip engaged with the positioning groove and the second groove.

4. The combination as claimed in claim 1, wherein the engaging hole has a plurality of first ridges and first grooves defined in an inner periphery thereof, the polygonal outer periphery of the insertion has a plurality of second ridges and second grooves, the first ridges are engaged with the second grooves and the second ridges are engaged with the first grooves.

* * * * *